United States Patent [19]

Kochanek et al.

[11] Patent Number: 4,995,950

[45] Date of Patent: Feb. 26, 1991

[54] PREPARATION OF ALKALI METAL NITRATES

[75] Inventors: Wolfgang Kochanek, Weisenheim; Bernd Leutner, Frankenthal, both of Fed. Rep. of Germany

[73] Assignee: BASF Aktiengesellschaft, Ludwigshafen, Fed. Rep. of Germany

[21] Appl. No.: 236,446

[22] Filed: Aug. 25, 1988

[30] Foreign Application Priority Data

Sep. 4, 1987 [DE] Fed. Rep. of Germany ..... 3729669

[51] Int. Cl.[5] ..... C25B 1/14

[52] U.S. Cl. ..... 204/91

[58] Field of Search ..... 204/91

[56] References Cited

U.S. PATENT DOCUMENTS 3,278,403 10/1966 Gardella et al. ..... 204/91

4,465,568 8/1984 Dotson et al. ..... 204/98

4,776,930 10/1988 Bianchi et al. ..... 204/91

OTHER PUBLICATIONS

Japanese Patent Publication 1694/1969.

European Search Report.

*Primary Examiner*—T. Tung

*Attorney, Agent, or Firm*—Keil & Weinkauf

[57] ABSTRACT

Alkali metal nitrates are prepared by supplying the anode space of an electrolysis cell, separated from the cathode space by a perm-selective cation exchange membrane, with alkali metal chloride solution and at the same time supplying the cathode space with a nitric acid/alkali metal nitrate solution whose alkali metal nitrate concentration is not less than 10% by weight and whose $HNO_3$ concentration is of from 0.1 to 10% by weight, and withdrawing from the cathode space a solution whose pH does not exceed 5.

5 Claims, 2 Drawing Sheets

Figure 1:
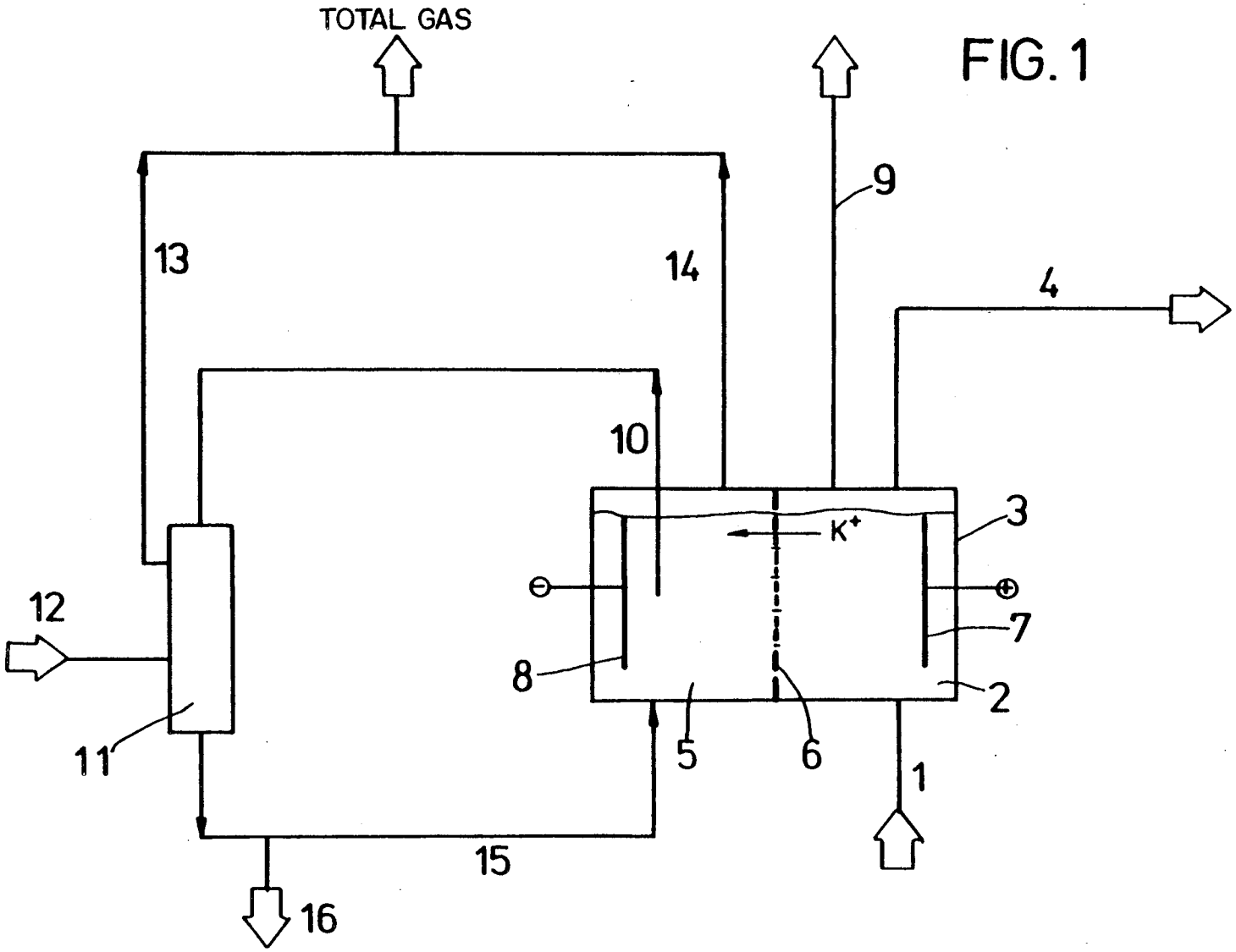

TOTAL GAS
K+
1
2
3
4
5
6
7
8
9
10
11
12
13
14
15
16

1
2
3
4
5
6
7
8
9
10
11
14
15
16
101
102
103
104
105
K+

PREPARATION OF ALKALI METAL NITRATES

The present invention relates to a process for preparing alkali metal nitrates by electrolysis of alkali metal chloride solutions in a membrane cell supplied with nitric acid.

Alkali metal nitrates, in particular sodium nitrate and potassium nitrate, are used for many industrial purposes and also as fertilizers. They can be isolated from natural sources or, alternatively, be produced synthetically.

In principle, they can be prepared purely chemically by reacting alkali metal carbonates or hydroxides with nitric acid or nitrogen oxides (Ullmann's Encyklopädie der technischen Chemie, Volume 15, 3rd edition, 1964, pages 54 to 61) or by reacting the corresponding chlorides with nitric acid. The latter option, however, is not simple to control industrially, inter alia on account of corrosion problems.

Japanese Patent Publication 1,694/1969 discloses a process for preparing alkali metal nitrates wherein an equilibrium solution of alkali metal chlorides and nitric acid is electrolyzed to produce chlorine and hydrogen. This process, however, does not give chloride-free nitrates, nor is the chlorine free of contamination with nitrogen oxides formed by cathodic reduction of nitric acid.

U.S. Pat. No. 4,465,568, finally, specifies a process for preparing a potassium nitrate/sodium nitrate mixture wherein a sodium chloride/potassium chloride brine is introduced into the anolyte space of an electrolysis cell, separated by a perm-selective cation exchange membrane from the cathode space. A solution containing potassium-sodium hydroxide is withdrawn from the cathode space and reacted outside the cell with nitric acid to give the corresponding nitrates. This process ultimately consists of two stages, namely the generation of an aqueous hydroxide solution by alkali metal chloride electrolysis in a first stage and the neutralization thereof with nitric acid in a second stage. The process has the serious disadvantage that the brine to be electrolyzed must before use be subjected to expensive micropurification for the purpose of removing calcium and magnesium salts in order to prevent precipitation of the corresponding hydroxides in the membrane. Otherwise, the membrane would quickly become clogged.

This external neutralization is said in the patent specification to be advantageous compared with a procedure where the neutralization of the alkali produced is effected by direct supply of nitric acid into the catholyte compartment, this being attributed to overheating in the cell, occasional overacidification and the like. These remarks show that in that art the intention still is to maintain a pH>7 in the cathode space.

Theoretically it would be desirable on the other hand to perform the electrolysis and neutralization in the electrolysis cell itself, since from the thermodynamic standpoint an in situ neutralization promises an appreciable gain in voltage. It is known in principle to perform electrolyses with simultaneous neutralization of the catholyte (Chemische Industrie 4/86, 256–257), but the observations are restricted to the preparation of salts of non-reducible anions, such as $Na_2SO_4$, $NaHSO_4$, $NaH_2PO_4$, $Na_2HPO_4$, $Na_3PO_4$, $Na_2CO_3$, $NaOOCCH_3$ and $Na_2C_2O_4$. This method is not simply appliable to the production of alkali metal nitrates, since nitric acid is reduced at the cathode to a wide range of nitrogen compounds, producing not only gaseous compounds such as $NO_2$, NO, $N_2O$ and $N_2$ but also compounds which remain in solution in the catholyte, such as $NH_4^+$, $NH_3OH^+$ and $NO_2^-$. Of these compounds, in particular the compounds $NO_2$ and $N_2O$ are undesirable, since with the former the amount of nitric acid consumed per mole of alkali metal nitrate produced is particularly large (on account of the small change in valence from $N^{+5}$ to $N^{+4}$), while with the latter there is the problem of washing this gas out of the offgas stream.

It is an object of the present invention to provide a process for preparing an alkali metal nitrate by electrolysis of an alkali metal chloride solution supplied to the anode space of an electrolysis cell, separated from the cathode space by a perm-selective cation exchange membrane, being supplied with nitric acid to the cathode space, where the proportion of nitric acid reduced at the cathode is minimal and where the reaction products of the nitric acid are easily worked up.

We have found that this object is achieved by supplying the cathode space with a nitric acid/alkali metal nitrate solution whose alkali metal nitrate concentration is not less than 10% by weight and whose $HNO_3$ concentration is from 0.1 to 10% by weight and withdrawing from the cathode space a solution whose pH does not exceed 5.

In the process according to the invention, chlorine evolves at the anode in accordance with the equation $$2\,Cl^- \rightarrow Cl_2 + 2\,e^-$$

while at the cathode a proportion of the nitrate is reduced to N-compounds of a lower oxidation state, namely $NO_2$, $NO_2^-$, NO, $N_2$, $NH_3OH^+$ and $NH_4^+$.

The alkali metal ion present in the anolyte passes through the cation exchange membrane into the cathode space, there to combine with further $HNO_3$ to form an alkali metal nitrate which is channeled out of the cathode space together with the catholyte.

Preferably, the nitric acid/alkali metal nitrate solution to be supplied to the cathode space contains not less than 25% by weight of alkali metal nitrate. The alkali metal nitrate concentration is limited at the top end by the solubility of the alkali metal nitrate at the particular temperature in the cathode space.

As a consequence of the fact that the cathode space is supplied not with pure nitric acid but with a mixture of nitric acid with an alkali metal nitrate, specifically the alkali metal nitrate corresponding to the alkali metal nitrate to be prepared, the concentration of the nitric acid can be maintained at from 0.1 to 10% by weight and hence the corrosive action of the catholyte solution can be kept to a minimum. On the other hand, care must be taken to ensure that the catholyte, on leaving the cathode space, has a pH of not more than 5; that is, in other words, that the catholyte is always acidic within the confines of the cathode space. For this reason there is no need to subject the brine to be introduced into the anolyte space to a micropurification for the purpose of cutting back the calcium and magnesium ion content to the sub-ppm range, since under the acidic catholyte conditions of the invention there is no precipitation of sparingly soluble calcium and/or magnesium compounds in the membrane.

The process according to the invention can be carried out in a plurality of electrolysis cells connected in series by introducing into the following cell the catholyte solution removed from the preceding cell, with or without addition of further nitric acid to maintain an $HNO_3$ concentration range of from 0.1 to 10% by weight, and withdrawing a concentrated alkali metal nitrate solution from the last cell.

It is particularly advantageous to carry out the process according to the invention in a single cell, in which case a portion of the catholyte solution withdrawn from the cell is withdrawn, this portion corresponding to the alkali metal nitrate formed in the cell, and the remaining solution is returned back into the cell after adjustment of the $HNO_3$ content to from 0.1 to 10% by weight by addition of fresh nitric acid and if necessary after adjustment of the alkali metal nitrate content. In this procedure, it is advantageous for the alkali metal nitrate concentration of the solution introduced into the cathode space to be not less than 25% by weight. If the process according to the invention is to be used to prepare solid alkali metal nitrate, this method minimizes the energy consumption for evaporation of the solution.

Since in the procedure according to the invention a proportion of the nitrate supplied in the form of nitric acid is reduced to ammonium ions, dissolved in the catholyte solution, it is advantageous to add to the solution introduced into the cathode space nitrite ions which react with the ammonium ion to give nitrogen. In this way, ammonium nitrate contamination of the alkali metal nitrate produced is avoided.

Plant for implementing the process according to the invention is schematically depicted in FIG. 1 by reference to the preparation of potassium nitrate as an example.

Passing through line (1), an aqueous potassium chloride solution containing not less than 70% of its saturation concentration of KCl enters the anolyte space (2) of the electrolysis cell (3) and anolyte is withdrawn through line (4). The anolyte space (2) is separated from the cathode space (5) by a perm-selective membrane (6). The anode (7) can consist for example of $RuO_2$-coated titanium and the cathode (8) of titanium. The anolyte space (2) discharges chlorine through line (9). The cathode space (5) discharges, through line (10), catholyte which, aside from potassium nitrate and free nitric acid, also contains cathodic reduction products $NO_2^-$, $NH_4^+$ and $NH_3OH^+$ and which is introduced into the reactor (11). This reactor (11) is supplied through line (12) with nitric acid having a concentration of from 30 to 68% by weight of $HNO_3$. Comproportionation of the dissolved $NO_2^-$ and $NH_4^+$ and decomposition of nitrite lead to the formation in this reactor of a gas mixture consisting essentially of $N_2$ and NO. These gaseous reaction products are drawn off through line (13) and leave the plant together with the gaseous reaction products NO, $N_2O$ and $N_2$ withdrawn from the cathode space (5) through line (14). The catholyte solution is returned through line (15) into the cathode space (5) after a portion has been drawn off through line (16). The catholyte solution withdrawn through line (16) can be cooled and/or evaporated to isolate the potassium nitrate in the form of crystals.

Figure 2:
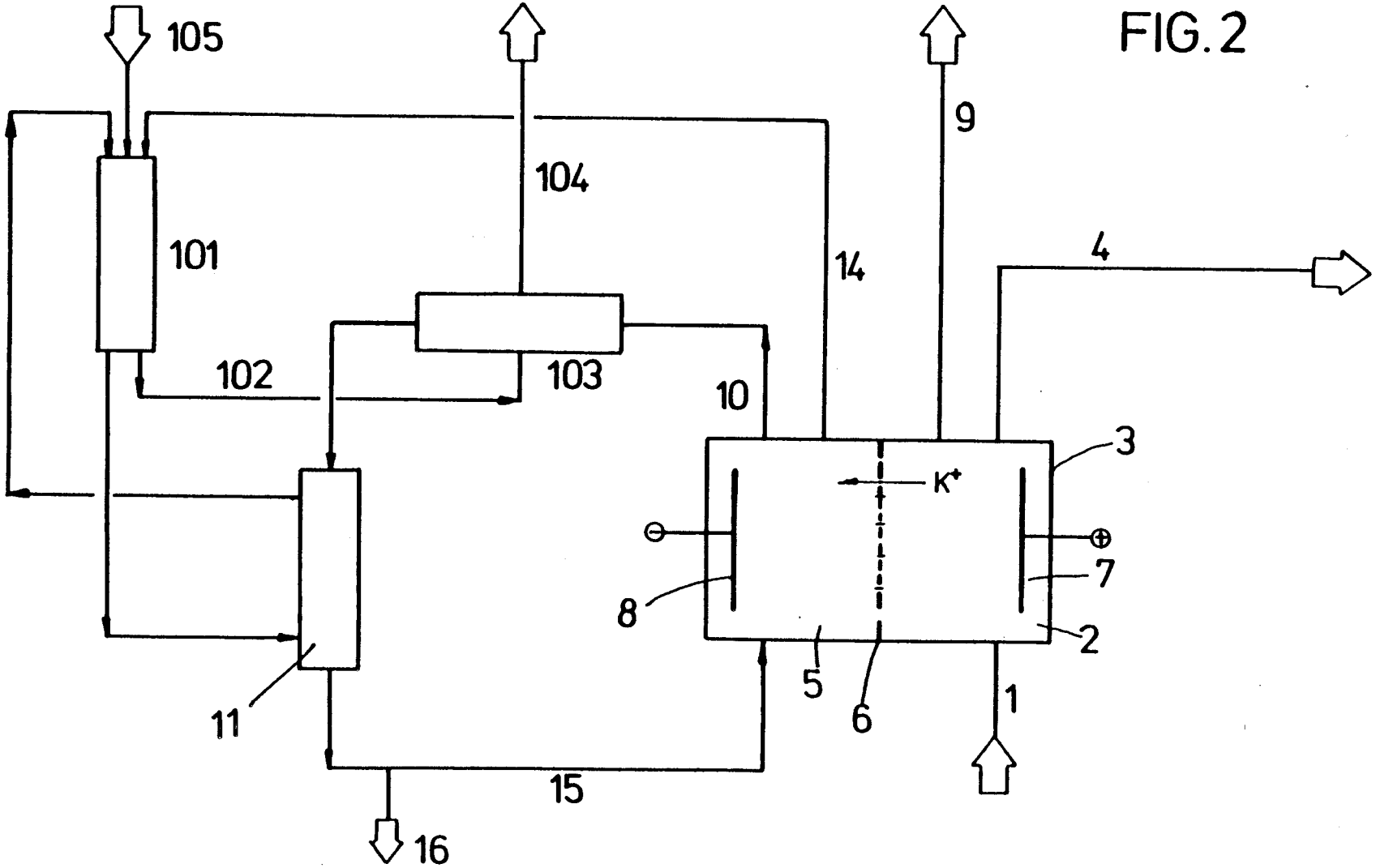

In FIG. 2, those parts of the plant which correspond to the parts of FIG. 1 bear the same reference numerals. Parts of the plant which differ bear three-digit reference numerals.

The essential difference with the plant depicted in FIG. 2 is the different manner of addition of nitric acid to the catholyte cycle.

Here the nitric acid is not introduced directly into the reactor (11) but is introduced via a line (105) into a washer (101), where it initially serves to oxidize the NO leaving the reactor (11) at least partially to $NO_2$, and only then flows into the reactor (11). The $NO_2$ and $N_2O_3$ produced in the washer (101) passes through line (102) into the absorber (103) where it is absorbed in the catholyte solution, forming nitrite which, as mentioned above, reacts with the catholyte ammonium to give $N_2$. The nitrogen, which may still contain traces of $NO_x$, is drawn off through line (104).

EXAMPLE 1

The anode space of an electrochemical cell divided by a perfluorinated cation exchange membrane of the sulfonic acid type is charged with 800 g/h of a KCl-containing brine saturated at 15° C. and adjusted to a pH of 1.5 with HCl (cf. FIG. 1). The anode, which has a geometric surface area of 100 $cm^2$ made up of expanded titanium metal coated with ruthenium oxide, evolves per hour at 86° C. and a current of 20 ampere 8.3 l of chlorine still containing about 0.5% by volume of oxygen. The cathode space of the cell is charged at 85° C. with 4.5 l per hour of a 47.0% strength by weight aqueous $HNO_3$ solution containing 2.5% by weight of free $HNO_3$. The cathode, which likewise consists of expanded titanium metal having a geometric surface area of 100 $cm^2$, evolves per hour about 2.2 l of a gas mixture which consists essentially of NO and $N_2$ in an $NO:N_2$ ratio of about 1:1.4. The catholyte leaving the cell is charged per hour with about 101 g of 60% strength by weight nitric acid, as a result of which the $HNO_3$-lean solution following passage through the cell is restored to the original acid content (2.5% by weight of $HNO_3$) before renewed entry into the cell. The gas formed downstream of the nitric acid feed point, comprising NO and $N_2$ in an approximate volume ratio of 1:3, is combined with the cathode gas leaving the cell, so that the gas mixture leaving the plant has the following composition:

42% by volume of NO
0.7% by volume of $N_2O$
55% by volume of $N_2$
1.8% by volume of $H_2$ Per hour the catholyte cycle is bled at a point downstream of the cell for 152 g of catholyte which, in addition to the $KNO_5$ formed, contains 0.3 g of $NH_4$/kg of solution. This output contains 48.3% by weight of $KNO_3$, so that the $K^+$-specific perm selectivity of the membrane comes out to 97.3%.

EXAMPLE 2

Under otherwise the same conditions as described in Example 1, the gases leaving the cathode space are washed countercurrent with the starting, 60% strength nitric acid, as shown in FIG. 2. In the course of this wash, the NO present in the cathode gas is oxidized to $NO_2$, a further two moles of $NO_2$ forming according to $$NO + 2\ HNO_3 \rightarrow 3\ NO_2 + H_2O$$

due to the reduction of nitric acid, so that the gas obtained at the outlet of the washer has approximately the following composition:

<0.2% by volume of NO
60.3% by volume of $NO_2$
38% by volume of $N_2$
0.3% by volume of $N_2O$
1.2% by volume of $H_2$ This gas is absorbed in a second washer in the catholyte leaving the cathode space, and the $NH_4^+$ dissolved in the catholyte reacts with the $NO_2$ formed in the course of absorption to give $N_2$. This washer accordingly discharges a mixture which is richer in $N_2$ and has approximately the following composition:

<0.2% by volume of NO
<0.5% by volume of $NO_2$
>97.0% by volume of $N_2$
<0.7% by volume of $N_2O$
<1.7% by volume of $H_2$ As a result of this mass flow scheme, the $NO_x$ content in the off-gas decreases appreciably and at the same time it is possible to reduce the $NH_4^+$ content of the catholyte. For instance, the $NH_4^+$ content in the $KNO_3$ output of the plant is only 0.06 g of $NH_4^+$/kg of solution.

We claim:

1. A process for preparing an alkali metal nitrate by electrolysis of an alkali metal chloride solution supplied to the anode space of an electrolysis cell, separated from the cathode space by a perm-selective cation exchange membrane, with nitric acid being supplied to the cathode space, which comprises supplying the cathode space with a nitric acid/alkali metal nitrate solution whose alkali metal nitrate concentration is not less than 25% by weight and whose $HNO_3$ concentration is of from 0.1 to 10% by weight and withdrawing from the cathode space a solution whose pH does not exceed 5.

2. The process of claim 1, wherein the solution withdrawn from the cathode space is bled for alkali metal nitrate at the rate of its production in the cathode space and the remainder, after the $HNO_3$ concentration has been adjusted to from 0.1 to 10% by weight by the addition of fresh nitric acid in a reaction zone and the gases formed in the course of this addition have been separated off, is recycled into the cathode space.

3. The process of claim 2, wherein the gases leaving the reaction space are contacted with the fresh nitric acid before the latter is introduced into the reaction zone.

4. The process of claim 3, wherein the gases treated with nitric acid are washed with the catholyte leaving the cathode space.

5. The process of claim 2, wherein the fresh nitric acid has a concentration of from 30 to 68% by weight.

* * * * *